US010222120B2

(12) United States Patent
Alekseev et al.

(10) Patent No.: US 10,222,120 B2
(45) Date of Patent: Mar. 5, 2019

(54) METHOD AND DEVICE FOR GENERATING TWO PURIFIED PARTIAL AIR STREAMS

(71) Applicant: LINDE AKTIENGESELLSCHAFT, Munich (DE)

(72) Inventors: Alexander Alekseev, Wolfratshausen (DE); Dimitri Goloubev, Munich (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 864 days.

(21) Appl. No.: 14/345,717

(22) PCT Filed: Sep. 20, 2012

(86) PCT No.: PCT/EP2012/003945

§ 371 (c)(1),
(2) Date: Mar. 19, 2014

(87) PCT Pub. No.: WO2013/053425

PCT Pub. Date: Apr. 18, 2013

(65) Prior Publication Data

US 2014/0223960 A1 Aug. 14, 2014

(30) Foreign Application Priority Data

Sep. 20, 2011 (DE) ..... 10 2011 113 666
Oct. 27, 2011 (EP) ..... 11008618

(51) Int. Cl.
*F25J 3/00* (2006.01)
*F25J 3/04* (2006.01)

(52) U.S. Cl.
CPC ..... *F25J 3/04* (2013.01); *F25J 3/0409* (2013.01); *F25J 3/04018* (2013.01);
(Continued)

(58) Field of Classification Search
CPC .. F25J 3/04012; F25J 3/04018; F25J 3/04157; F25J 3/04775; F25J 2205/62;
(Continued)

(56) References Cited

U.S. PATENT DOCUMENTS 4,662,916 A * 5/1987 Agrawal ..... F25J 3/04157 62/646
4,806,136 A * 2/1989 Kiersz ..... F25J 3/04157 62/646
(Continued)

FOREIGN PATENT DOCUMENTS

DE 102007027073 A1 * 12/2008
DE 102007027073 A1 12/2008
(Continued)

OTHER PUBLICATIONS

International Search Report dated Jul. 7, 2014 issued in corresponding PCT/EP2012/003945 application (pp. 1-3).

*Primary Examiner* — Keith Raymond
(74) *Attorney, Agent, or Firm* — Millen White Zelano & Branigan, PC

(57) ABSTRACT

The invention relates to a method and device for generating two purified partial air streams under different pressures. A total air stream (1) is compressed to a first total air pressure. The compressed total air stream (5) is cooled with cooling water under the first total air pressure by way of heat exchange (4, 6). The heat exchange with cooling water for cooling the total air stream (5) is carried out as a direct heat exchange in a first direct contact cooler (6), at least in part. The cooled total air stream (9) is divided into a first partial air stream (10) and a second partial air stream (11). The first partial air stream (10) is purified in a first purification device (18) under the first total air pressure, generating the first purified partial air stream (19). The second partial air stream (11) is re-compressed to a higher pressure (12), which is
(Continued)

higher than the first total air pressure. The re-compressed second partial air stream (14) is cooled with cooling water in a second direct contact cooler (15) by way of direct heat exchange (13, 15). The cooled second partial air stream (17) is purified under the higher pressure in a second purification device (30), thus generating the second purified partial air stream (31).

13 Claims, 1 Drawing Sheet

(52) U.S. Cl.
CPC ..... *F25J 3/0486* (2013.01); *F25J 3/04157* (2013.01); *F25J 3/04169* (2013.01); *F25J 3/04181* (2013.01); *F25J 3/04206* (2013.01); *F25J 3/04218* (2013.01); *F25J 3/04303* (2013.01); *F25J 3/04309* (2013.01); *F25J 3/04448* (2013.01); *F25J 3/04878* (2013.01); *F25J 3/04884* (2013.01); *F25J 3/04957* (2013.01); *F25J 2200/54* (2013.01); *F25J 2205/32* (2013.01); *F25J 2205/34* (2013.01); *F25J 2205/62* (2013.01); *F25J 2210/06* (2013.01); *F25J 2230/04* (2013.01); *F25J 2230/40* (2013.01); *F25J 2235/52* (2013.01); *F25J 2250/04* (2013.01); *F25J 2250/40* (2013.01); *F25J 2250/50* (2013.01)

(58) Field of Classification Search
CPC .. F25J 2210/06; F25J 2220/02; F25J 2230/02; F25J 2230/04
See application file for complete search history.

(56) References Cited

U.S. PATENT DOCUMENTS 5,692,397 A * 12/1997 Higginbotham ..... F25J 3/0409 62/646
6,453,659 B1 9/2002 Van Liere et al.

FOREIGN PATENT DOCUMENTS

| | | | |
|---|---|---|---|
| DE | 202008012985 | U1 | 2/2009 |
| EP | 0342436 | A2 | 11/1989 |
| FR | 2878294 | A1 | 5/2006 |
| FR | 2946099 | A1 | 12/2010 |
| GB | 1028254 | A | 5/1966 |

* cited by examiner

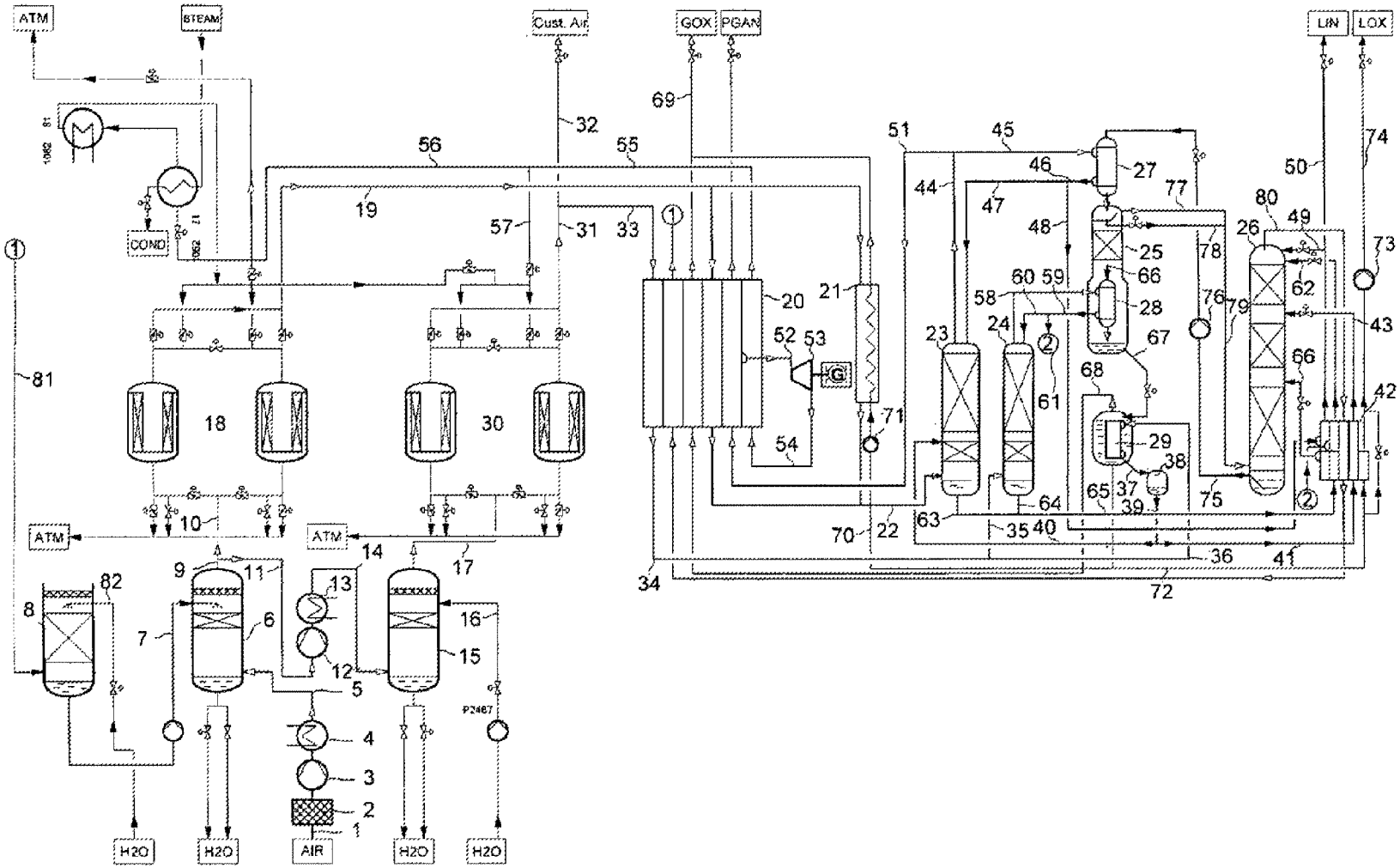
LOX
LIN
GOX
PGAN
Cust. Air
STEAM
ATM
COND
AIR
H2O
G

METHOD AND DEVICE FOR GENERATING TWO PURIFIED PARTIAL AIR STREAMS

The invention relates to a method for generating two purified air substreams at different pressures.

A "condenser-evaporator" denotes a heat exchanger in which a first condensing fluid stream comes into indirect heat exchange with a second evaporating fluid stream. Each condenser-evaporator has a liquefaction chamber and an evaporation chamber which consist of liquefaction passages or evaporation passages, respectively. In the liquefaction chamber, a first fluid stream is condensed (liquefied) and in the evaporation chamber, a second fluid stream is evaporated. Evaporation and liquefaction chambers are formed by groups of passages which are in a heat-exchange relationship with one another.

A condenser-evaporator can be constructed, for example, as a falling-film or bath evaporator. In a "falling-film evaporator", the film that is to be evaporated flows from top to bottom through the evaporation chamber and is partially evaporated in the course of this. In a "bath evaporator" (sometimes also termed "circulation evaporator" or "thermosiphon evaporator") the heat-exchanger block is in a liquid bath of the fluid that is to be evaporated. This flows owing to the thermosiphon effect from bottom to top through the evaporation passages and exits again at the top as a two-phase mixture. The remaining liquid flows outside the heat-exchanger block back into the liquid bath (in a bath evaporator, the evaporation chamber can comprise not only the evaporation passages but also the outer chamber around the heat-exchanger block).

The condenser-evaporator for the low-pressure column (the low-pressure column intermediate evaporator and the low-pressure column sump evaporator) can be arranged in the interior of the low-pressure column or in one or more separate containers.

EP 342436 A2 discloses compressing a total air stream (1) to a first total air pressure, dividing into two air substreams, boosting one of these and purifying the two air substreams in two purification appliances which are operated at different pressures for the compression.

The object of the invention is to design such a method and a corresponding device in such a manner that they are energetically particularly expedient to operate.

This object is achieved by a method for generating two purified air substreams at different pressures, in which

- a total air stream is compressed to a first total air pressure,
- the compressed total air stream is cooled at the first total air pressure by heat exchange with cooling water,
- the heat exchange with cooling water for cooling the total air stream is carried out at least in part as direct heat exchange in a first direct contact cooler,
- the cooled total air stream is divided into a first air substream and a second air substream,
- the first air substream is purified at the first total air pressure in a first purification appliance and obtained as a first purified air substream,
- the second air substream is boosted to a higher pressure which is higher than the first total air pressure,
- the boosted second air substream is cooled by heat exchange with cooling water,
- the heat exchange with cooling water for cooling the boosted second air substream is carried out at least in part as direct heat exchange in a second direct contact cooler,

- the cooled second air substream is purified at the higher pressure in a second purification appliance and obtained as a second purified air substream.

In the invention, the total air stream, before division thereof, is cooled by direct heat exchange with cooling water in the first direct contact cooler to a particularly low temperature which is, in particular, below the ambient temperature. Using conventional aftercoolers or intercoolers, such a low temperature cannot usually be achieved. At this particularly low temperature, the second air substream then enters the boosting. The corresponding volume reduction at the intake of the recompressor effects a noticeable improvement of the efficiency of the boosting and thereby saves energy.

Upstream of the first direct contact cooler, a conventional aftercooler can be connected, in which the total air stream, after the compression thereof to the first total air pressure, is cooled by indirect heat exchange with cooling water to a temperature which is generally higher than the ambient temperature. The cooling of the total air between compression and division to the two air substreams can, however, also be performed solely in the first direct contact cooler.

The heat exchange with cooling water for cooling the boosted second air substream (14) could alternatively in principle proceed indirectly. In the invention, this cooling, however, is carried out at least in part as direct heat exchange in a second direct contact cooler. Upstream of the second direct contact cooler, a conventional aftercooler can be connected, in which the boosted second air substream is cooled by indirect heat exchange with cooling water to a temperature which is generally higher than the ambient temperature. However, the cooling can alternatively be performed solely in the direct contact cooler.

All compression steps can be accomplished in a multistage manner and then each have preferably one conventional intercooling between each pair of successively following stages.

The invention further relates to the use of the above method for providing feed air at two different pressure levels for a low-temperature fractionation of air wherein a first purified air substream and a second purified air substream are generated and at least a part of the first purified air substream and at least a part of the second purified air substream are introduced into a distillation column system for nitrogen-oxygen separation.

The invention further relates to a device having

- a main air compressor for compressing a total air stream to a first total air pressure,
- a first direct contact cooler for cooling the compressed total air stream at the first total air pressure by direct heat exchange with cooling water,
- means for dividing the total air stream cooled in the first direct contact cooler into a first air substream and a second air substream,
- a first purification appliance for purifying the first air substream at the first total air pressure,
- means for obtaining the first air substream as a first purified air substream stream downstream of the first purification appliance,
- a booster for boosting the second air substream to a higher pressure which is higher than the first total air pressure,
- a second direct contact cooler for cooling the boosted second air substream by direct heat exchange with cooling water,
- a second purification appliance for purifying the cooled second air substream at the higher pressure and having means for obtaining the second air substream as a second purified air substream stream downstream of the second purification appliance.

The device according to the invention can be supplemented by device features which correspond to the features described for the method.

BRIEF DESCRIPTION OF THE DRAWINGS

The invention and further details of the invention will be described in more detail hereinafter with reference to an exemplary embodiment shown schematically in FIG. 1.

Atmospheric air 1 is drawn in by suction in FIG. 1 via a filter 2 by a main air compressor 3 with aftercooler 4 and there compressed to a first total air pressure of 3.1 bar. The main air compressor can have two or more stages with intercooling; for reasons of redundancy it is preferably constructed in two lines (both are not shown in the drawing). The total air stream 5 is fed at the first total air pressure and a temperature of 295 K to a first direct contact cooler 6 and there further cooled to 283 K in direct heat exchange with cooling water 7 from an evaporative cooler 8. The cooled total air stream 9 is divided into a first air substream 10 and a second air substream 11.

The second air substream 11 is compressed in a booster 12 with aftercooler 13 from the first total air pressure (minus pressure drops) to a second total air pressure of 4.9 bar. The booster can have two or more stages with intercooling; for reasons of redundancy it is preferably constructed in two lines (both are not shown in the drawing). Each line of the main air compressor and the booster can be constructed as one machine having a shared drive, in particular as a geared compressor. The second air substream 14 is then cooled from 295 K to 290 K in a second direct contact cooler 15, more precisely in direct heat exchange with a warmer cooling water stream 16.

The first air substream is purified in a first purification appliance 18 which is operated at the first total air pressure, and then passed via line 19 at this pressure to the warm end of a main heat exchanger, which in the exemplary embodiment is formed by two blocks 20, 21 connected in parallel. The air cooled to about dew point forms a "first feed air stream", which is fed to a first high-pressure column 23.

The first high-pressure column 23 is part of a distillation column system for nitrogen-oxygen separation which, in addition, has a second high-pressure column 24, a low-pressure column consisting of two sections 25, 26, a low-pressure column intermediate evaporator 27, a low-pressure column sump evaporator 28 and an auxiliary condenser 29. The low-pressure column intermediate evaporator 27 and the low-pressure column sump evaporator 28 are constructed as falling-film evaporators, and the auxiliary condenser 29 as a bath evaporator.

The precooled second air substream 17 is purified in a second purification appliance 30 which is operated at the second total air pressure. From the purified second air substream, via line 32, a small part can be withdrawn which is used as instrument air or for purposes outside the air fractionation. The remainder flows via line 33 to the main heat exchanger 20 and is there cooled. The cooled second air substream 34 is divided into a "second feed air stream" 35 which is introduced into the second high-pressure column 24, and into a "third feed air stream" 36, which is passed to the liquefaction chamber of the auxiliary condenser 29.

The at least partially, preferably substantially completely, condensed third substream 37 is introduced into a separator (phase separator) 38. The liquid fraction 39 is fed in a first part 40 to the first high-pressure column 23. In a second part 41, it is fed via a subcooling countercurrent heat exchanger 42 and line 43 into the low-pressure column 26.

Nitrogen-rich overhead gas 44 of the first high-pressure column 23 is condensed in a first part in the low-pressure column intermediate evaporator 27. Here, liquid nitrogen 46 that is obtained is applied in a first part 47 as reflux to the top of the first high-pressure column 23. A second part 48 is cooled in the subcooling countercurrent heat exchanger 42 and applied via line 49 as reflux to the top of the low-pressure column 26. A part 50 of the subcooled liquid can if required be obtained as liquid product (LIN).

A second part 51 of the nitrogen-rich overhead gas 44 of the first high-pressure column 23 is introduced into the main heat exchanger 20. At least a part 52 thereof is only warmed to an intermediate temperature and is then work-producingly expanded in a generator-braked compressed nitrogen turbine 53 from 2.7 bar to 1.25 bar. The outlet pressure of the turbine is already sufficient to force the work-producingly expanded stream 54 through the main heat exchanger 20 and via the lines 55, 56, 57 as regeneration gas through the first and the second purification appliances 18, 30.

A further part of the stream 51 is warmed to ambient temperature in the main heat exchanger 20 and obtained as gaseous pressurized nitrogen product (PGAN).

Nitrogen-rich overhead gas 58 of the second high-pressure column 24 is condensed in the low-pressure column sump evaporator 28. In this process, liquid nitrogen 59 that is obtained is applied in a first part 60 as reflux to the top of the second high-pressure column 24. A second part 61 is cooled in the subcooling countercurrent heat exchanger 42 and applied via line 62 as reflux to the top of the low-pressure column 26.

The sump liquids 63, 64 of the two high-pressure columns 23, 24 are combined, and fed via line 65, the subcooling countercurrent heat exchanger 42 and line 66 to the low-pressure column 26.

The sump liquid 66 of the low-pressure column 25 is introduced into the evaporation chamber of the low-pressure column sump evaporator 28 and there in part evaporated. The fraction 67 remaining liquid flows into the evaporation chamber of the auxiliary condenser 29 and is there in part evaporated. The evaporated fraction 68 is passed to the cold end of the main heat exchanger block 20, warmed to about ambient temperature and finally, via line 69, obtained as gaseous oxygen product (GOX) of a purity of 95 mol %. The fraction remaining liquid is, as a part 70, in a pump 71, evaporated and warmed to a pressure of 6 bar in the main heat exchanger block 21 and finally admixed to the gaseous oxygen product 69. Another part 72 can be obtained as liquid oxygen product (LOX) via the subcooling countercurrent heat exchanger 42, pump 73 and line 74.

A liquid intermediate fraction 75 which occurs at the bottom end of the second low-pressure column section 26 is transported by means of a pump 76 into the evaporation chamber of the low-pressure column intermediate evaporator 27 and there in part evaporated. Steam generated in this process is passed together with steam produced at the top of the first low-pressure column section 25, via the lines 77 and 79 to the second low-pressure column section 26, optionally together with circulating purge liquid 78. The remainder of the intermediate fraction remaining liquid serves as reflux liquid in the first low-pressure column section 25.

At the top of the low-pressure column 26, nitrogen-rich residual gas 80 is taken off at a pressure of 1.26 bar and, after warming in the subcooling countercurrent heat exchanger 42 and main heat exchanger 20 is fed via line 81 virtually unpressurized as dry gas into the evaporative cooler 8 and there utilized for cooling down cooling water 82.

The invention claimed is:

1. A method for generating two purified air substreams at different pressures, comprising:

compressing a total air stream (1) to a first total air pressure, cooling the compressed total air stream (5) at the first total air pressure by heat exchange (4, 6) with cooling water, wherein the heat exchange with cooling water for cooling the total air stream (5) is carried out at least in part as direct heat exchange in a first direct contact cooler (6), dividing the cooled total air stream (9) into a first air substream (10) and a second air substream (11), purifying the first air substream (10) at the first total air pressure in a first purification appliance (18) to obtain a first purified air substream (19), further compressing (12) the second air substream (11) to a pressure which is higher than the first total air pressure, cooling the further compressed second air substream (14) by heat exchange (13, 15) with cooling water, wherein the heat exchange with cooling water for cooling the further compressed second air substream (14) is carried out at least in part as direct heat exchange in a second direct contact cooler (15), and the cooling water introduced into said second direct contact cooler (15) is warmer than the cooling water introduced into said first direct contact cooler (6), purifying the cooled second air substream (17) at the higher pressure in a second purification appliance (30) to obtain a second purified air substream (31).

2. The method as claimed in claim 1, wherein the total air stream (5) is cooled in the first direct contact cooler (6) to a temperature which is below the ambient temperature.

3. A method for the low-temperature fractionation of air in a distillation column system for nitrogen-oxygen separation, comprising generating said first purified air substream and said second purified air substream in accordance with claim 1, and introducing at least a part of the first purified air substream and at least a part of the second purified air substream into a distillation column system for nitrogen-oxygen separation.

4. The method as claimed in claim 1, wherein, upstream of the first direct contact cooler and after the compression of the total air stream to the first total air pressure, said total air stream is cooled by indirect heat exchange (4).

5. The method as claimed in claim 2, wherein, upstream of the first direct contact cooler and after the compression of the total air stream to the first total air pressure, said total air stream is cooled by indirect heat exchange (4) to a temperature which is higher than ambient temperature.

6. The method as claimed in claim 1, wherein upstream of the first direct contact cooler, the cooling water (7) used in said first direct contact cooler (6) is cooled in an evaporative cooler (8) by heat exchange with nitrogen-rich residual gas (80) from a distillation column system used for low-temperature fractionation of air.

7. The method as claimed in claim 2, wherein upstream of the first direct contact cooler, the cooling water (7) used in said first direct contact cooler (6) is cooled in an evaporative cooler (8) by heat exchanger with nitrogen-rich residual gas (80) from a distillation column system used for low-temperature fractionation of air.

8. The method as claimed in claim 6, wherein, upstream of the first direct contact cooler and after the compression of the total air stream to the first total air pressure, said total air stream is cooled by indirect heat exchange (4).

9. The method as claimed in claim 7, wherein, upstream of the first direct contact cooler and after the compression of the total air stream to the first total air pressure, said total air stream is cooled by indirect heat exchange (4) to a temperature which is higher than ambient temperature.

10. A method as claimed in claim 3, wherein, before said at least a part of said first purified air substream and said at least a part of said second purified air substream are introduced into said distillation column system, said first purified air substream and said second purified air substream are cooled in a main heat exchanger (20, 21) by heat exchange with process streams from said distillation column system.

11. A method for the low-temperature fractionation of air in a distillation column system for nitrogen-oxygen separation, comprising:

(a) generating a first purified air substream and a second purified air substream by compressing a total air stream (1) to a first total air pressure, cooling the compressed total air stream (5) at the first total air pressure by heat exchange (4, 6) with cooling water, wherein the heat exchange with cooling water for cooling the total air stream (5) is carried out at least in part as direct heat exchange in a first direct contact cooler (6), dividing the cooled total air stream (9) into a first air substream (10) and a second air substream (11), purifying the first air substream (10) at the first total air pressure in a first purification appliance (18) to obtain a first purified air substream (19), further compressing (12) the second air substream (11) to a pressure which is higher than the first total air pressure, cooling the further compressed second air substream (14) by heat exchange (13, 15) with cooling water, wherein the heat exchange with cooling water for cooling the further compressed second air substream (14) is carried out at least in part as direct heat exchange in a second direct contact cooler (15), and the cooling water introduced into said second direct contact cooler (15) is warmer than the cooling water introduced into said first direct contact cooler (6), purifying the cooled second air substream (17) at the higher pressure in a second purification appliance (30) to obtain a second purified air substream (31), and (b) introducing at least a part of the first purified air substream and at least a part of the second purified air substream into a distillation column system for nitrogen-oxygen separation, wherein said distillation column system comprises a first high-pressure column (23), a second high-pressure column (24), a low-pressure column having a first section (25) and a second section (26), and an auxiliary condenser 29, and said at least a part of the first purified air substream is introduced into said first high-pressure column (23) and a first portion (35) of said at least a part of the second purified air substream is introduced into said second high-pressure column (24), and a second portion (36) of said at least a part of the second purified air substream is introduced into said auxiliary condenser (29) where said second portion (36)

of at least a part of the second purified air substream is cooled by indirect heat exchange with liquid removed from the bottom of said first section (25) of said low-pressure column.

12. A method as claimed in claim 11, wherein, after being at least partially condensed in said auxiliary condenser (29), said second portion (36) of said at least a part of the second purified air substream is introduced into a separator (38), and a first part (40) of a liquid fraction (39) from said separator is introduced into said first high-pressure column (23), and a second part (41) of said liquid fraction (39) from said separator (38) is subcooled in a countercurrent heat exchanger (42) and then introduced into said second section (26) of said low-pressure column.

13. The method as claimed in claim 11, wherein upstream of the first direct contact cooler, the cooling water (7) used in said first direct contact cooler (6) is cooled in an evaporative cooler (8) by heat exchange with nitrogen-rich residual gas (80) removed from said second section (26) of said low-pressure column.

* * * * *